US007083393B2

(12) United States Patent
Myers et al.

(10) Patent No.: US 7,083,393 B2
(45) Date of Patent: Aug. 1, 2006

(54) COMBINATION SIGHT GLASS, STRAINER AND ORIFICE

(75) Inventors: Timothy A. Myers, New Carlisle, IN (US); Douglas J. Wood, LaPorte, IN (US); Mark A. Firnhaber, LaPorte, IN (US)

(73) Assignee: Sullair Corporation, Michigan City, IN (US)

( * ) Notice: Subject to any disclaimer, the term of this patent is extended or adjusted under 35 U.S.C. 154(b) by 398 days.

(21) Appl. No.: 10/654,552

(22) Filed: Sep. 3, 2003

(65) Prior Publication Data

US 2005/0047931 A1 Mar. 3, 2005

Related U.S. Application Data

(60) Provisional application No. 60/407,186, filed on Aug. 30, 2002.

(51) Int. Cl.
*F04B 49/00* (2006.01)

(52) U.S. Cl. ..... 417/63; 418/2; 418/DIG. 1

(58) Field of Classification Search ..... 417/572, 417/63; 418/2, DIG. 1; 210/94, 95; 73/323
See application file for complete search history.

(56) References Cited

U.S. PATENT DOCUMENTS

| | | | | |
|---|---|---|---|---|
| 4,915,823 | A * | 4/1990 | Hall | 210/95 |
| 5,088,897 | A * | 2/1992 | Kawai et al. | 417/269 |
| 5,112,201 | A * | 5/1992 | Tamura et al. | 417/366 |
| 5,776,332 | A * | 7/1998 | Hurner | 210/95 |
| 6,554,595 | B1 * | 4/2003 | Hida et al. | 418/201.1 |
| 6,942,468 | B1 * | 9/2005 | Sauerbier et al. | 417/411 |
| 2005/0123406 | A1 * | 6/2005 | Clark et al. | 417/52 |
| 2005/0129549 | A1 * | 6/2005 | Baltes et al. | 417/572 |
| 2005/0180869 | A1 * | 8/2005 | Ursan et al. | 417/440 |

* cited by examiner

*Primary Examiner*—Tae (Ted) J Kim
*Assistant Examiner*—Vikansha Dwivedi
(74) *Attorney, Agent, or Firm*—Stephen G. Mican

(57) ABSTRACT

A sight glass block for inspecting oil flow through a scavenge line for an oil separation system in a compressor comprises a combination of a sight glass for inspecting the oil flow, a strainer for cleaning the oil flow and an orifice for metering the oil flow in a single integrated component.

1 Claim, 2 Drawing Sheets

SECTION A-A

COMBINATION SIGHT GLASS, STRAINER AND ORIFICE

CROSS REFERENCE TO RELATED APPLICATIONS

This Application claims the benefit of the filing date for prior filed co-pending Provisional Application Ser. No. 60/407,186, filed 30 Aug. 2002.

FIELD OF THE INVENTION

The invention relates to oil-flooded screw compressors, and more particularly to oil separation systems for such compressors.

BACKGROUND OF THE INVENTION

Oil-flooded screw compressors are designed with an oil separation system located on the discharge side of the compressor and comprise an oil receiver that cause most of the oil in the air stream to drop out and a coalescing filter pack, generally comprising one or two coalescing elements. The oil that is removed by the coalescing filter pack collects at the bottom of the elements and must be removed and returned to the compressor oil system. The oil is removed by a scavenge line that returns the oil to a low-pressure section of the compressor.

The pressure difference causes the oil to flow. The flow in the scavenge line must be regulated by an orifice to minimise the corresponding loss in compressor output. To prevent the orifice form plugging up, a strainer is used upstream of the orifice. To facilitate troubleshooting, a sight glass is also installed in the line to observe the flow of oil so that plugging of the strainer can be monitored.

Up until now, all of these components have been separate components connected together with pipe fittings. This arrangement has resulted in numerous leaks because of the number of pipe connections required.

SUMMARY OF THE INVENTION

The invention comprises a sight glass block that combines strainer, sight glass and orifice into a single component, thereby eliminating up to seventy percent of connections used in conventional oil separation systems for oil-flooded screw compressors.

DESCRIPTION OF THE INVENTION

Figure 1:
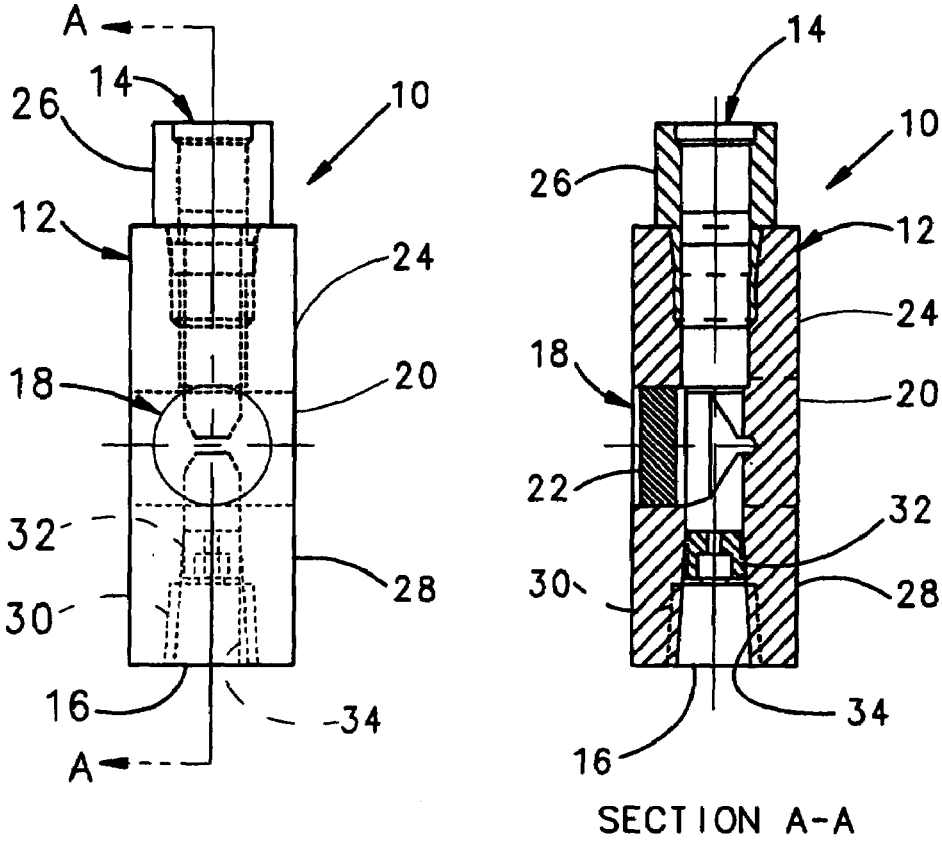
FIG. 1 shows a preferred embodiment of the invention.

FIG. 1 shows a preferred embodiment of the invention that combines strainer, sight glass and orifice functions into a single sight glass block component 10. The sight glass block 10 has a machined manifold 12 with an inlet port 14, an outlet port 16, and a sight glass aperture 18, all interconnected to allow oil flow from the inlet port 14 through the output port to be viewed through the sight glass aperture 18. The manifold 12 preferably accepts SAE "O"-ring type fittings to improve sealing performance. The manifold 12 is preferably nickel-plated to secure light reflecting properties that enhance visibility of the oil flow past the sight glass.

The manifold 12 has a central sight glass section 20 that comprises the sight glass aperture 18 that extends partly through the manifold. The sight glass aperture 18 incorporates a heat-sealed glass disc 22 that functions as a sight glass.

The manifold 12 has an inlet port section 24 above the sight glass section 20 that comprises the inlet port 14 in fluidic communication with the sight glass aperture 18. The inlet port 14 preferably comprises an "O"-ring port that is larger than required, such as a connecting line and a strainer fitting 26 that is threaded into the manifold 12, with the strainer screen fitting 26 incorporated inside the manifold 12. The use of an "O"-ring type fitting improves the reliability of the seal. This is especially important for the strainer fitting 26, because it must be periodically removed for servicing, and the "O"-ring seal type fitting can be disassembled and reinstalled many times without wearing out and causing a leak. The strainer fitting 26 is preferably constructed of an SAE "O"-ring port adapter that has been modified by welding the strainer screen onto the end of the adapter, making a replaceable part.

The manifold 12 has an outlet port section 28 below the sight glass section 20 that comprises the outlet port 16 in fluidic communication with both the sight glass aperture 18 and the inlet port 14. The outlet port section 28 comprises an internal threaded section 30 that accepts a mating threaded orifice insert 32 and an "O"-ring type fitting 34 in fluidic communication with the orifice insert 32. The orifice fitting 34 is thus completely internal to the manifold, thereby eliminating any leakage outside of the oil flow path. The orifice insert feature also permits orifice fitting of varying orifice diameters to be installed, depending on the expected flow rate in the scavenge line. It permits the same sight glass block 10 to be used with any size of screw compressor.

Figure 2:
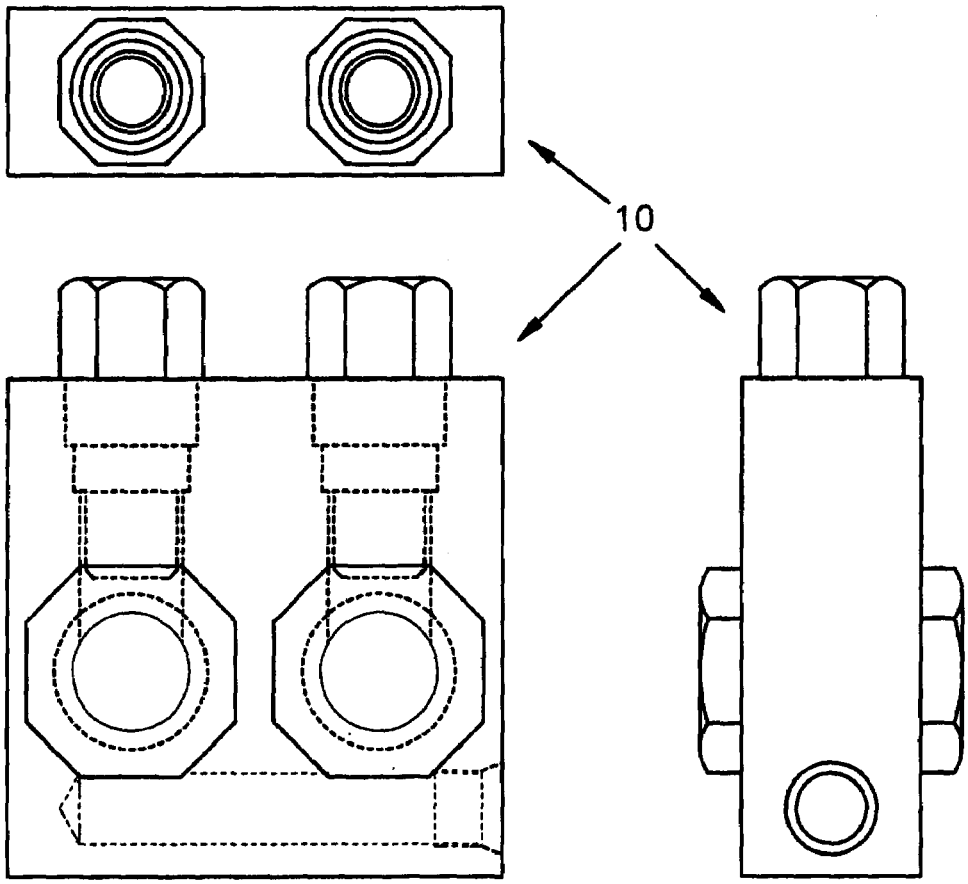
FIG. 2 shows an alternate embodiment of the invention with dual scavenge lines when two coalesces are used.

An alternate embodiment of the invention is shown in FIG. 2 that is suitable for use with dual scavenge lines. It incorporates two of the assemblies described above into one sight glass block 10 for applications where two scavenge lines are required.

Thus there has been described herein a sight glass block that combines strainer, sight glass and orifice functions into a single component. It should be understood that the embodiment described above is only one illustrative implementation of the invention, that the various parts and arrangement thereof may be changed or substituted, and that the invention is only limited by the scope of the attached claims.

What is claimed is:

1. Apparatus for combining strainer, sight glass and orifice functions into a single component inserted in an oil separation system located on the discharge side of a compressor, comprising:

a sight glass block manifold that has a central sight glass section comprising a sight glass aperture that extends partly through the manifold with a heat-sealed glass disc that functions as a sight glass;

an inlet port section above the sight glass section that comprises an inlet port in fluidic communication with the sight glass aperture and that has an "O"-ring port that is larger than required by a connecting line and a strainer fitting that is threaded into the manifold, with the strainer screen incorporated inside the manifold; and an outlet port section below the sight glass section that comprises an outlet port in fluidic communication with both the sight glass aperture and the inlet port and that has an internal threaded section that accepts a mating threaded orifice insert and an "O"-ring type fitting in fluidic communication with the orifice insert.

* * * * *